United States Patent [19]

Morris

[11] Patent Number: 4,830,081

[45] Date of Patent: May 16, 1989

[54] CURVED VERTICAL BLIND WITH SLAT TRAVERSING AND ROTATION

[75] Inventor: John E. Morris, Lake Mills, Wis.

[73] Assignee: Graber Industries, Inc., Middleton, Wis.

[21] Appl. No.: 111,662

[22] Filed: Oct. 23, 1987

[51] Int. Cl.[4] ..... E06B 9/30

[52] U.S. Cl. ..... 160/168.1; 160/178.1; 160/900

[58] Field of Search ..... 160/168.1, 178.1, 900, 160/176.1

[56] References Cited

U.S. PATENT DOCUMENTS 4,122,884 10/1978 Salzmann .
4,653,564 3/1987 Marocco ..... 160/177 X
4,657,060 4/1987 Kaucic .

FOREIGN PATENT DOCUMENTS 1470533 4/1977 United Kingdom .

*Primary Examiner*—Blair M. Johnson
*Attorney, Agent, or Firm*—Vernon Pillote

[57] ABSTRACT

A curved vertical blind comprising a generally horizontal longitudinally curved guide track and a normally straight resiliently bendable operating rod rotatably supported on the track. Slat support carriages are provided and which have a first carriage part guidably mounted on the curved guide track for movement therealong and a second carriage part guidably mounted on the first part for movement relative thereto in a direction crosswise of the guide track. The second carriage part guideably engages the blind operating rod for shifting thereby relative to the first carriage part crosswise of the guide track to accommodate changes in the spacing between the operating rod and the guide track. Slat carriers are rotatably supported on the second carriage part for turning about generally upright axis, and a drive means is provided on the second carriage part for drivingly connecting the blind operating rod to the slat carriers for rotating the latter in response to turning of the operating rod. The mechanism for rotatably supporting the blind operating rod includes thrust means engaging opposite ends of the rod for applying end thrust to maintain the rod in a resiliently bowed position, and one of the thrust applying means is adjustable to adjust the bow in the rod to a curve approximating the longitudinal curve of the carriage track.

17 Claims, 1 Drawing Sheet

CURVED VERTICAL BLIND WITH SLAT TRAVERSING AND ROTATION

PRIOR ART

Most vertical blind installations use straight rods or tracks. However, in some installations involving curved or bowed windows, it is desirable to provide a vertical blind that can conform generally to the curvature of the window while allowing traversing of the slats between open and closed positions and rotation of the slats at all positions of the slat along the channel.

U.K. Patent No. 1,470,533 published Apr. 14, 1977, discloses a curved vertical blind of the type having a longitudinally curved carriage guide channel with a resiliently bendable blind operating rod that is rotatably supported at its ends on the channel and extends lengthwise of the channel and through slat support carriages that are movable along the channel, to rotate the slat carriers on the carriages in response to turning of the operating rod. Curved vertical blinds of this type have also heretofore been made by the assignee of the present invention, by forming the carriage guide channel of normally straight vertical blinds of the type disclosed in U.S. Pat. Nos. 4,657,060 and 4,122,884, into a permanently formed curve. However, the operating rod must rotate to turn the slats on the carriages and therefore cannot be formed into a permanent curve. Instead, the operating rod must be resiliently bowed to extend along the curved guide channel. The slat support carriages support and guide the rod when the blind is in a closed condition with the carriages spaced generally uniformly along the guide channel. However, when the carriages are moved toward an open position, the curvature of the resiliently bowed rod tends to decrease. The differences between the curvature of the rod and the curvature of the track markedly increase the forces required for traversing the carriages along the track and increases wear on the components. In addition, as the curvature of the operating rod decreases, the chord length between the ends of the rod increases and in the prior curved vertical blinds known to applicant, end thrust on the rod was applied to the mechanism for rotating the rod and this not only caused the drive to bind and resist rotation but also increased wear on the drive components. Even a very small change in the curvature of the operating rod produces a substantial change in the chordal length of the operating rod and difficulties were encountered in cutting the length of the operating rod so that it would not apply excessive end thrust to the drive mechanism when the curvature of the rod decreased during opening of the blind, without allowing one or the other end of the rod to drop out of the track, as the curvature of the operating rod increased during closing of the blind.

BRIEF SUMMARY OF THE INVENTION

It is an object of the present invention to provide a curved vertical blind having an improved slat support casing which will accommodate differences between the curvature of the carriage guide channel and the operating rod and minimize binding of the slat support carriages as they move along the carriage guide channel.

Another object of this invention is to provide an improved arrangement for adjustably applying end thrust to the operating rod to adjust the bow in the operating rod to a longitudinal curve approximating the longitudinal curve of the carriage guide track.

Another object of this invention is to provide a curved vertical blind in accordance with the foregoing object, and which prevents application of end thrust from the operating rod to the mechanism for rotating the operating rod.

The present invention relates to a curved vertical blind of the type including a generally horizontal longitudinally curved carriage guide track, a resiliently bendable blind operating shaft rotatably supported on the carriage guide track with the shaft resiliently bowed into a longitudinal curve to extend along the carriage guide track, means for rotating the blind operating shaft, a plurality of slat support carriages, and means for moving the carriages along the guide track between a blind open and blind closed positioned.

In accordance with one aspect of the present invention, at least some of the carriages are floating carriages, with each floating carriage including a first carriage part guidably mounted on the carriage guide track for movement therealong between the blind open and blind closed positions, a second carriage part guidably mounted on the first carriage part for movement with the first carriage part along the carriage guide track and for limited movement relative to the first carriage part in a generally horizontal direction crosswise of the guide track, the second carriage part having means guidably engaging the blind operating shaft for shifting the second carriage part relative to the first carriage part in a direction crosswise of the guide track to at least partially accommodate differences in curvature of the track and operating rod as the carriages are moved along the track, slat support means mounted on the second carriage part for turning relative thereto about a generally upright axis, and means on the second carriage part for drivingly connecting the blind operating rod to the respective slat support means for rotating the slat support means in response to turning of the blind operating rod.

In accordance with another aspect of the present invention, the curved vertical blind is provided with first and second thrust means engaging the shaft adjacent opposite ends for applying end thrust thereto, and at least one of the end thrust means is adjustable in a direction longitudinally of the associated end of the shaft to adjust the bow in the shaft to a longitudinal curve approximating the longitudinal curve of the carriage guide track.

In accordance with still another aspect of the present invention, the curved vertical blind is provided with means for transmitting end thrust from the operating rod directly to a part fixed to the carriage guide track and without applying end thrust to the shaft operating mechanism.

BRIEF DESCRIPTION OF THE DRAWINGS

FIG. 3 is a fragmentary vertical sectional view taken on the plane 3—3 of FIG. 2B;

FIG. 4 is an exploded perspective view of the adjustable end support for the blind operating shaft;

FIG. 5 is a fragmentary vertical sectional view taken on the plane 5—5 of FIG. 2*a* and illustrating parts of the drive operating mechanism on a larger scale;

FIG. 6 is a fragmentary vertical sectional view illustrating a modified form of adjustable end support for the operating rod;

FIG. 7 is an exploded perspective view of one form of floating carriage assembly;

FIG. 8 is a transverse sectional view through the vertical blind showing the floating carriage of FIG. 7;

FIG. 9 is a transverse sectional view through a vertical blind illustrating a modified form of floating carriage; and FIG. 10 is a perspective view illustrating a third form of floating carriage.

Referring more particularly to FIG. 1 of the drawings, there is disclosed a curved vertical blind for use with curved and bow windows. The blind includes a generally horizontal carriage guide channel 10 having a top wall 11, spaced side walls 12 and 13 and inwardly directed upper and lower rails 14*a* and 14*b* defining a carriage guide track. Flanges 15 are provided on the lower edge of the side walls 12 and 13 and spaced apart to define a downwardly opening slot at the bottom of the channel. The channel is formed into a longitudinal curve in a generally horizontal plane with a radius of curvature to generally correspond to the curvature of the curved or bow window. The curved vertical blinds can be made in a wide range of curvatures, preferably not less than about five or six feet. As shown in FIG. 1, the curved channel has a radius of curvature designated R, a chord length CL, and a height or bow projection designated H.

Figure 1:
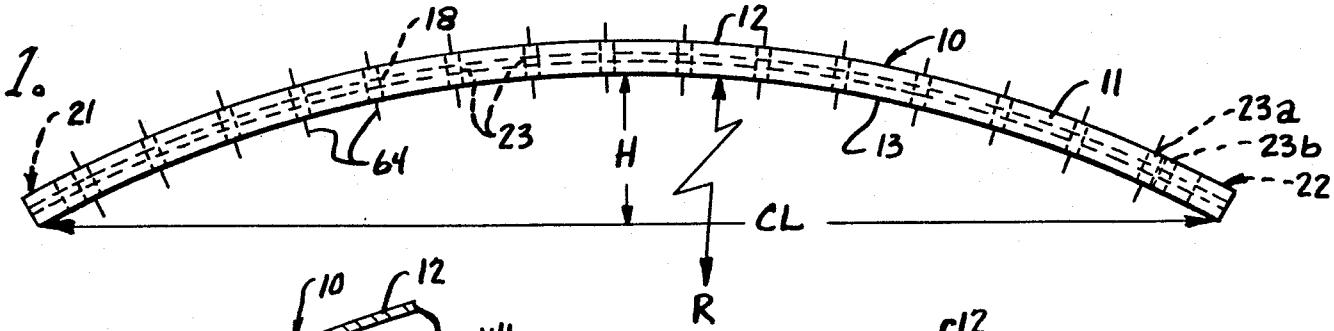
FIG. 1 is a diagrammatic top plan view of a curved vertical blind illustrating the blind in a closed condition.

A blind operating rod 18 is provided and formed of a resiliently bendable material such as aluminum, plastic or a composite metal and plastic such as disclosed in U.K. Patent No. 1,470,533. A blind operating mechanism 21 is provided on one end of the carriage guide channel for supporting and rotating the blind operating rod, and a rod support 22 is provided on the other end of the channel for supporting the other end of the blind operating rod. A plurality of carriages 23 are mounted in the channel 10 for movement therealong and the carriages are moved along the guide channel between blind open and blind closed positions by a traverse mechanism. A slat carrier 24 is mounted on each carriage for rotation relative thereto about an upright axis, and a carrier drive mechanism 25 is provided on each carriage for rotating the slat carrier in response to turning of the blind operating rod.

The blind operating rod 18 must be resiliently bowed to extend along the longitudinally curved carriage guide channel and even small changes in the radius of curvature of the operating rod produce substantial changes in the length of the chord between the ends of the operating rod. In order to bow the resiliently bendable operating rod 18 to a curve approximating the curve of the track, provision is made for applying end thrust to opposite ends of the operating rod and for adjusting the end thrust to adjust the bow or curvature in the operating rod to approximate the curvature of the carriage guide channel.

The blind operating mechanism 21 for rotatably supporting and driving the operating rod 18 is preferably of the speed reducing type to rotate the operating rod at a reduced speed. The operating mechanism is conveniently of the planetary gear type disclosed in U.S. Pat. No. 4,657,060 and, as shown in FIGS. 2A and 5, includes a stationary housing 31 mounted by a generally L-shaped bracket 32 on the carriage guide channel 10. The bracket 32 has a portion 32*a* that extends across one end of the channel and a portion 32*b* that underlies the top of the channel with a depending lip 32*c* arranged to engage the upper rail 14*a* of the carriage guide track. The L-shaped bracket 32 is anchored against movement relative to the channel by screws 32*d* threaded in the portion 32*b* and which engage the underside of the channel to press the leg 32*c* downwardly against the rail 14*a*.

The blind operating mechanism 21 includes an annular internal ring gear 33 fixed to the housing; a planet carrier 34 mounted for rotation about the axis of the ring gear; a drive wheel 35 mounted for rotation about the axis of the ring gear; a sun gear 36 extending axially into the ring gear, and at least one and preferably several planetary gears 37 in meshing engagement with the sun and ring gears and mounted on axles 34*a* on the planet carrier for rotation about axes parallel to the axis of the ring gear and spaced radially inwardly from the ring gear. The drive wheel 35 has a drive sprocket 35*a* disposed coaxially with the ring gear and a flexible chain 38 is entrained over the drive sprocket and has downwardly extending runs adapted to be drawn or pulled to rotate the drive sprocket in one direction or the other. The planet carrier 34 has an axially extending hub 34*b* which is internally splined to non-rotatably receive an end of the externally splined blind operating shaft 18. With this construction, rotation of the drive sprocket will effect rotation of the hub 34*b* in the same direction as the drive sprocket, but at a relatively reduced speed, for example a speed reduction of about five to one. As shown, the hub 34*b* of the planetary gear is rotatably supported in a sleeve portion 31*a* on the housing, to thereby radially support the end of the operating pinion 18.

Provision is made for applying end thrust to the operating rod 18 in a manner which avoids application of end thrust to the speed reducing blind operating mechanism. For this purpose, a thrust pin 41 is mounted with one end engaging the end of the operating rod 18 and its other end arranged to engage a thrust button 42 mounted on the portion 32*a* of the L-shaped bracket 32. The thrust button 42 has a reduced diameter portion 42*a* that extends through an opening in the portion 32*a* of the L shaped bracket to be radially centered thereby and the thrust button engages the inner face of the part 32*a*. The thrust pin 41 extends into a socket 42*b* in the thrust button and the socket is preferably dimensioned so that the thrust pin is freely rotatable therein. The thrust pin extends through an axial opening in the drive wheel 35 and through an axial opening in the sun gear and an axial opening in the planet carrier into engagement with the end of the operating rod 18. The openings in the drive wheel and sun gear are preferably dimensioned to allow free rotation of the thrust pin relative thereto and the opening in the planetary carrier is dimensioned to receive the thrust pin with a press fit so that the thrust pin rotates with the planet carrier and hub 34*b*. The thrust button 42 is formed of a wear resistant material, for example a nylon or acetal plastic. A resilient brake pad 46 conveniently formed of a foamed plastic or rubber is preferably provided between the drive wheel 35 and the thrust button to lightly retard rotation of the drive wheel.

Figure 2B:
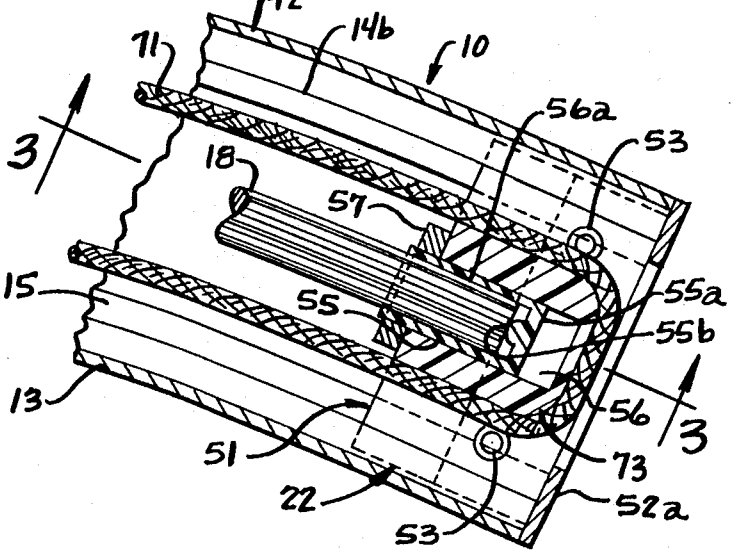
FIGS. 2A and 2B are fragmentary horizontal sectional views through opposite end portions of a curved vertical blind and illustrating parts on a larger scale than FIG. 1.
Figure 2A:
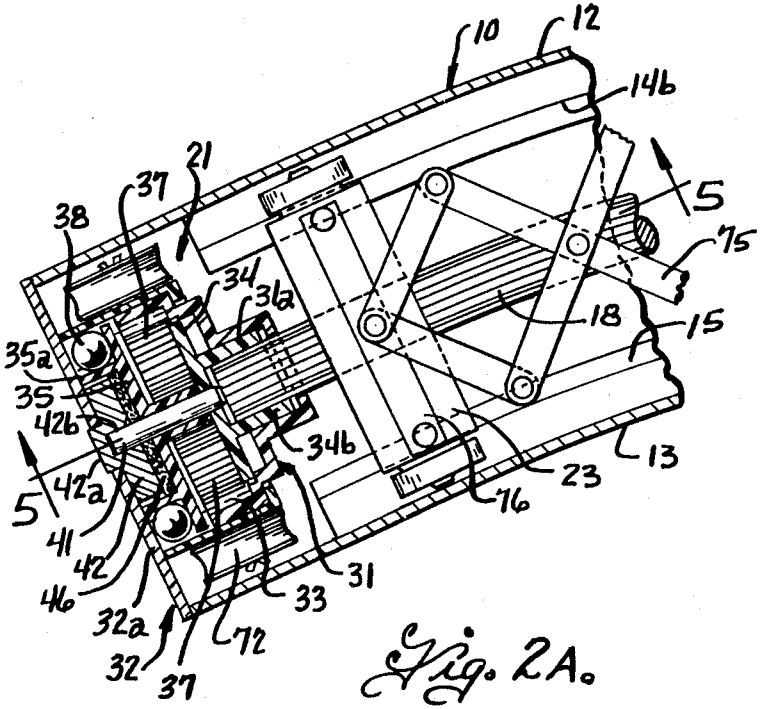

The rod support 22 shown in FIGS. 2B, 3 and 4 is arranged to rotatably support the other end of the blind operating rod 18, and to adjust the end thrust applied to the rod to change the curvature of the rod. The rod support 22 includes a housing 51 mounted as by an L-shaped bracket 52 on the other end of the carriage guide channel 10. The L-shaped bracket 52 includes a part 52*a* that extends across and closes the other end of the carriage guide channel, and a part 52*b* that is attached, as by rivets 53 or the like to the housing 51. The housing 51 underlies the top wall of the channel 10 and has lateral portions that engage the top rail 14*a* of the guide track, and a means such as screws 54 are threaded into the housing 51 and engage the underside of the channel to press the housing firmly against the upper guide rails and anchor the housing against endwise movement in the channel.

The housing 51 has a thrust member mounted thereon for adjustment in a direction lengthwise of the adjacent end of the operating rod 18. In the embodiment shown in FIGS. 2B, 3 and 4, the thrust member 55 is in the form of a sleeve that is slidably and non-rotatably supported in a socket 56 in the housing 51. The sleeve 55 has an end wall 55*a* at its inner end and a thrust button 55*b* on the inner side of the end wall arranged to engage the end of the blind operating rod. The sleeve 55 is externally threaded and has key means such as flats 55*c* that extend lengthwise thereof and slidably and non-rotatably engage flats 56*a* on the socket 56. A rotary adjusting member or thumb wheel 57 is threadedly mounted on the externally threaded sleeve and abuts against a shoulder 51*b* on the end of the housing 51, such that turning of the-adjusting wheel in one direction moves the sleeve axially in one direction to increase the end thrust on the end of the rod 18 and, conversely, to decrease the end thrust on the end of the rod when turned in the other direction. As will be apparent from FIG. 3, the thumb wheel 57 is accessible through the open slot in the bottom of the carriage guide channel, so that the end thrust on the rod 18 can be readily adjusted after the vertical blind is installed, even when the ends of the guide channel are located closely adjacent a window casing or wall.

A modified form of rod support member is shown in FIG. 6 and like numerals are used to designate the same parts and like numerals followed by the postscript ′ used to designate similar but modified parts. In this embodiment, the rod support member 22′ includes a housing 51′ attached to an L-shaped end bracket 52. As in the preceding embodiment, the end bracket 52 includes a part 52*a* that extends across the end of the channel and a part 52*b* that is attached as by rivets 53 to the housing 51′. The housing 51′ is supported on the top rail 14*a* of the channel and screws such as the previously mentioned screws 54 are provided to engage the underside of the channel to anchor the housing against endwise movement in the channel.

The housing 51′ has a socket 56′ for slidably and rotatably receiving the end of the blind operating rod 18. A thrust member 55′ is slidably and non-rotatably supported in the housing and, as shown in FIG. 6, includes a head portion 55*a′* having a polygonal configuration that is slidably and non-rotatably supported in a polygonal passage 56*a′* in the housing, and an externally threaded portion 55*b′* that extends slidably through a passage 56*b′* in the housing and into the passage 56′, to engage the end of the rod 18. A rotary adjusting member such as the thumb wheel 57′ is threadedly mounted on the portion 55*b′* and engages a shoulder 51*b′* on the housing to adjust the end thrust on the rod 18 when the thumb wheel is rotated.

As previously described, the vertical blind includes a plurality of slat support carriages 23 guidably mounted on the channel 10 for movement therealong, and slat carriers 24 mounted on each carriage for rotation relative thereto about a generally upright axis. The carrier drive mechanism on each carriage drivingly connects the blind operating rod 18 to the slat carrier 24 for rotating the latter about an upright axis in response to turning of the operating rod. Slats 64 (FIG. 1) are mounted on the slat carriers for turning thereby.

The bow in the resiliently bendable operating rod 18 can be adjusted by adjusting the end thrust to the ends of the rod so that the operating rod can be bowed into a curve that approximates longitudinal curve of the carriage guide channel. However, it is not possible to exactly match the curve in the resiliently bendable rod with that of the carriage guide channel with the result that the spacing between the operating rod and the side walls of the guide channel vary somewhat at different points along the guide channel. In prior slat support carriages such as disclosed in U.K. Patent No. 1,470,533 and U.S. Pat. No. 4,122,884, variations in the side-to-side spacing of the operating rod with respect to the side walls of the guide channel at different locations along the channel tended to cause the carriages to drag or bind at some locations along the channel, resulting in high traverse forces and extra component wear. In accordance with another aspect of the present invention, a floating carriage is provided which will accommodate some variation between the curvature of the carriage guide channel and the operating rod, as the slat support carriages are traversed along the carriage guide channel. As shown in FIGS. 7 and 8, the floating carriages include a first carriage part 65 which is guidably mounted on the carriage guide track for movement therealong between a blind open and a blind closed position, and a second carriage part 66 that is guidably mounted on the first carriage part for movement with the first carriage part along the carriage guide track and for limited movement relative to the first carriage part in a generally horizontal direction crosswise of the guide track. The second carriage part has a portion 67 thereon which guidably engages the blind operating rod for shifting the second carriage part relative to the first carriage part in a direction crosswise of the carriage guide track, to accommodate some differences in curvature of the track and rod as the carriage is moved along the guide track. The slat carriers 24 are rotatably supported on the second carriage part for turning movement relative thereto about a generally upright axis, and the carrier drive mechanism 25 is provided on the second carriage part for rotating the slat support carrier 24 about an upright axis in response to turning of the operating rod 18. In the preferred embodiment illustrated in FIGS. 7 and 8, the first carriage part 65 comprises a generally rigid body formed of plastic or the like that is guidably supported and guided as by rollers 69 on the upper and lower rails 14*a* and 14*b* on the side walls 12 and 13 of the carriage guide channel. The first carriage part 65 is laterally confined between the side walls 12, 13 and the rails 14*a*, 14*b* thereon so that it follows the curvature of the carriage guide channel during movement of the carriages therealong. The second carriage part 66 of the floating carriage is slidably supported in a guideway formed by walls 65*a*, 65*b* and 65*c* and flanges 65*d* on the part 65 for movement relative thereto in a direction crosswise of the carriage guide channel. The part 66 has a length measured between its end walls 66*a* which is substantially less than the spacing between the walls 65*e* of the first carriage part 65 so that the second part can shift relative to the first part through a distance sufficient to accommodate substantial differences in the spacing between the operating rod 18 and the side walls of the guide channel. The portion 67 of the second carriage part 66 closely surrounds the operating rod so that the part 66 is guided by the operating rod and shifts relative to the part 65 during movement of the carriages along the rod.

In the embodiment of FIGS. 7 and 8, the carrier drive mechanism 25 for drivingly connecting the operating rod 18 to the slat carrier 24 is of the rack and pinion type generally disclosed in U.S. Pat. No. 4,122,884. As shown in FIGS. 7 and 8, the operating rod 18 is longitudinally splined to provide uniformly spaced circumferentially spaced teeth and a rack member 68 is slidably mounted in the second carriage part 66 for movement in a direction crosswise of the pinion rod and has one row of rack teeth 68*a* that mesh with the teeth on the operating rod 18, and a second row of rack teeth 68*b* that mesh with a pinion gear 24*a* on the slat carrier 24. The slat carrier 24 has a neck portion 24*b* that is rotatably supported in a yoke 66*c* on the second-carriage part 66 so that the slat carrier is rotated about an upright axis in response to turning of the operating rod 18.

A traverse mechanism is provided for moving the carriages along the carriage guide channel between a blind open and a blind closed position. In the embodiments illustrated, the traverse mechanism is of the cord type in which a traverse cord 71 has generally horizontal runs that extend from cord guides such as pulleys 72 at one end of the rod and through cord guide passages 65*f* in the carriages and over a cord guide 73 on the end-fitting 22 at the other end of the rod. As is well understood in the art, one run of the traverse cord is connected to one of the carriages, hereinafter referred to as a master carriage designated 23*a* in FIG. 1, to move the master carriage along the guide channel. The traverse mechanism also includes means for controlling the spacing between the carriages 23, at least when the blind is in its closed position shown in FIG. 1. The carriage spacing means may be of the pantograph type such as disclosed in U.S. Pat. No. 3,280,891 in which a pantograph mechanism designated 75 is connected to each of the carriages as by a bracket 76. Alternatively, carriage spacing means may comprise spacer links such as disclosed in U.S. Pat. No. 4,122,884 and U.K. Patent No. 1,470,533. In such spacer link arrangements a spacer link is anchored to each carriage and slidably engages an adjacent carriage with a stop at the distal end of the spacer link arranged to limit the maximum spacing between adjacent carriages.

A modified form of floating carriage is illustrated in FIG. 9 and like numerals are used to designate the same parts and with like numerals followed by the postscript ′ used to designate modified parts. In this embodiment, a first carriage part 65′ extends crosswise of the guide channel and has rollers 69′ at opposite ends that guidably engage the rails 14*a*, 14*b* on the side walls of the guide channel. A second carriage part 66′ is supported on the carriage part 65′ for movement therewith along the carriage guide channel and for limited movement relative thereto in a direction crosswise of the guide channel, and the second carriage part 66′ has a portion 67′ that guidably engages the operating rod 18 so that the second carriage part 66′ is shifted laterally of the guide track relative to the carriage part 65′ to accommodate differences in the spacing between the operating rod 18 and one or the other of the side walls of the channel. A carrier drive mechanism 25′, conveniently of the rack and pinion type described in connection with the preceding embodiment is provided on the shiftable carriage part 66′ to drivingly interconnect the operating rod 18 to the pinion gear on the shaft carrier 24, to rotate the latter in response to turning of the operating rod.

A further modified form of floating carriage is illustrated in FIG. 10 and like numerals followed by the postscript ″ are used to designate corresponding parts. The floating carriage includes a first carriage part 65″ that is guidably supported as by rollers 69″ on the carriage guide channel, and a second carriage part 66″ that is mounted on the first carriage part for limited movement relative thereto in a direction crosswise of the guide channel. In this embodiment, the carrier drive mechanism 25″ for drivingly connecting the operating rod 18 to the slat carriers 24″ is of the worm and worm wheel type generally disclosed in U.K. patent No. 1,470,533. In general, the carrier drive mechanism 25″ includes a worm gear 68*a″* that is rotatably supported on the second carriage part 66″ and which slidably and non-rotatably engages the operating rod 18. The worm gear 68*a″* meshes with a worm wheel 24*a″* on the slat carrier to rotate the slat carrier in response to turning of the operating rod 18.

From the foregoing it is thought that the construction and operation of the curved vertical blind will be readily understood. The first carriage part of each of the carriages is guidably mounted on the curved carriage guide channel so that the first carriage part follows the curvature of the guide channel and the second carriage part is guided on the operating rod to follow the curvature of the operating rod and is shifted laterally relative to the first carriage part to accommodate changes in the spacing of the operating rod relative to the side walls of the curved guide channel. The slat support carriers are rotatably supported on the laterally shiftable second carriage part and the carrier drive mechanism for interconnecting the operating rod in the slat support carrier is also mounted on the second carriage part so that lateral shifting of the second carriage part does not cause turning of the slat carrier. Turning of the slat carrier is achieved by rotation of the operating rod.

Provision is made for adjustably applying end thrust to the operating rod so as to bow the resilient operating rod to a curvature that approximates the curvature of the curved carriage guide channel. The bow in the operating rod can be adjusted after installation of the blind, by turning the thumb wheel that is adjustable through the open slot in the bottom of the guide channel. An auxiliary carriage designated 23b may be provided and operated by the traverse cord as more fully disclosed in U.S. Pat. No. 4,122,884, to support the traverse cords and operating rod when the blind is in an open condition.

The embodiments of the invention in which an exclusive property or privilege is claimed are defined as follows:

1. A curved vertical blind closure with slat traversing and rotation comprising, a generally horizontal carriage guide track, the track being longitudinally curved in a generally horizontal plane, a normally straight resiliently bendable blind operating rod, means rotatably supporting the blind operating rod on the track with the rod resiliently bowed into a longitudinal curve approximating the longitudinal curve of the track, means for rotating the rod, a plurality of carriages, and means for moving the carriages along the track between a blind open and a blind closed position, at least some of carriages being floating carriages, each floating carriage including:

(a) a first carriage part guidably mounted on the track for movement therealong between the blind open and blind closed positions, (b) a second carriage part guidably mounted on the first carriage part for movement with the first carriage part along the track and for limited movement relative to the first carriage part in a generally horizontal direction crosswise of the track, the second carriage part having means guidably engaging the blind operating rod for shifting the second carriage part relative to the first carriage part in said direction crosswise of the track to at least partially accommodate differences in curvature of the track and rod as the carriages are moved along the track, (c) slat support means mounted on the second carriage part for turning movement relative thereto about a generally upright axis, and (d) means on the second carriage part for drivingly connecting the rod to the respective slat support means for rotating the slat support means in response to turning of the rod.

2. A curved vertical blind closure according to claim 1 wherein said means for rotatably supporting the rod on the track includes first and second thrust means engaging the rod adjacent opposite ends for applying end thrust thereto sufficient to maintain the rod in a resiliently bowed condition.

3. A curved vertical blind according to claim 1 wherein said means for rotatably supporting the rod on the track includes first and second thrust means engaging the rod adjacent opposite ends for applying end thrust thereto, at least one of said thrust means being adjustable in a direction longitudinally of the associated end of the rod to adjust the bow in the rod to a longitudinal curve approximating the longitudinal curve of the track.

4. A curved vertical blind closure according to claim 1 including means engaging the first carriage part for spacing the carriages generally uniformly along the track when the carriages are in the blind closed position.

5. A curved vertical blind closure according to claim 1 including pantograph means connected to the first carriage part of the floating carriages for controlling spacing between the floating carriages during movement along the track.

6. A curved vertical blind closure with slat traversing and rotation comprising, a generally horizontal carriage guide channel having opposed side walls and inwardly directed rails thereon defining a carriage guide track and a lengthwise extending slot along its bottom, the channel being longitudinally curved in a generally horizontal plane, a normally straight resiliently bendable blind operating rod, means for rotatably supporting the rod on the channel with the rod resiliently bowed into a longitudinal curve approximating the longitudinal curve of the channel, means for rotating the rod, a plurality of carriages, means for moving the carriages along the guide channel between a blind open and a blind closed position, at least some of said carriages being floating carriages, each floating carriage including:

(a) a first carriage part extending crosswise of the channel and guidably mounted on the guide tracks between opposite side walls of the channel for movement therealong between the blind open and blind closed positions, (b) a second carriage part guidably mounted on the first carriage part for movement with the first carriage part along the track and for limited movement relative to the first carriage part in a generally horizontal direction crosswise of the channel, the second carriage part having means guidably engaging the rod for shifting the second carriage part relative to the first carriage part in said generally horizontal direction crosswise of the channel to at least partially accommodate differences in the spacing between the blind operating rod and the side walls of the channel as the floating carriages are moved along the channel, (c) slat support means mounted on the second carriage part for turning movement relative thereto about a generally upright axis, and means on the second carriage part for drivingly connecting the rod to the slat support means for rotating the slat support means in response to turning of the rod.

7. A curved vertical blind closure according to claim 6 wherein said means for rotatably supporting the rod on the channel includes first and second thrust means engaging the rod adjacent opposite ends for applying end thrust thereto sufficient to maintain the rod in a resiliently bowed condition.

8. A curved vertical blind according to claim 6 wherein said means for rotatably supporting the rod on the channel includes first and second thrust means engaging the rod adjacent opposite ends for applying end thrust thereto, at least one of said thrust means being adjustable in a direction longitudinally of the associated end of the rod to adjust the bow in the rod to a longitudinal curve approximating the longitudinal curve of the channel.

9. A curved vertical blind according to claim 6 wherein said means for rotatably supporting the rod on the channel includes a first thrust means mounted on one end of the channel and engaging one end of the rod for applying end thrust thereto, said means for rotating the rod including a speed reducing drive mechanism mounted on a second end of the channel and drivingly connected to said rod adjacent a second end thereof, and a second thrust means engaging said second end of said rod for applying end thrust thereto while substantially avoiding application of end thrust from the rod to said speed reducing drive mechanism, at least one of said thrust means being adjustable in a direction longitudinally of the associated end of the rod to adjust the bow of the rod to a longitudinal curve approximating the longitudinal curve of the channel.

10. A curved vertical blind according to claim 6 wherein said means for rotatably supporting the rod on the channel includes a first thrust means mounted on one end of the channel and engaging one end of the rod for applying end thrust thereto, said means for rotating the rod including a speed reducing drive mechanism having a housing means fixed to a second end of the channel, an annular internal ring gear in the housing means coaxial with the rod, a planet carrier supported for rotation about the axis of the ring gear and having an axial hub non-rotatably connected to a second end of said rod, a drive wheel having a sun gear at one side extending into the ring gear concentrically of the latter and a drive sprocket at the other side coaxial with the ring gear, at least one planet gear in meshing engagement with the sun and ring gears and mounted on the planet carrier for rotation relative thereto about an axis parallel to the axis of the ring gear, and a second thrust means mounted on the housing means and including a thrust member extending axially through the drive wheel and sun gear and planet carrier and into engagement with said second end of said rod to apply end thrust thereto.

11. A curved vertical blind according to claim 10 wherein one of said thrust means is adjustable in a direction longitudinally of the associated end of the rod to adjust the bow of the rod to a longitudinal curve approximating the longitudinal curve of the channel.

12. A curved vertical blind according to claim 6 wherein said means for rotatably supporting the rod on the channel includes first and second thrust means for engaging the respective first and second ends of the rod to apply end thrust thereto, one of said thrust means including an end member mounted on one end of the channel, an elongated thrust member slidably and non-rotatably mounted on said end member for movement relative thereto along an axis coaxial with the adjacent end of the rod, the thrust member having an externally threaded portion, and a rotary adjusting member threaded on said externally threaded portion and engaging said end member to adjust the thrust member relative to the end member, said rotary adjusting member being accessible for rotation through the slot at the bottom of the channel to facilitate adjustment of the bow in the rod after the channel is installed.

13. A curved vertical blind according to claim 6 including pantograph means connected to the first carriage parts of the floating carriages for controlling the spacing of the carriages as they are moved along the channel.

14. A curved vertical blind closure with slat traversing and rotation comprising, a generally horizontal carriage guide track, the track being longitudinally curved in a generally horizontal plane, a normally straight resiliently bendable blind operating rod, means rotatably supporting the rod on the track, means for rotating the rod, a plurality of carriages, means for moving the carriages along the track between a blind open and a blind closed position, said means for rotatably supporting the rod on the track including first and second end members fixedly mounted on the tracks adjacent opposite ends thereof, and first and second thrust means on the first and second end members respectively engaging the rod adjacent opposite ends for applying end thrust thereto, at least one of said thrust means being adjustable relative to its associated end member in a direction longitudinally of the associated end of the rod to adjust the bow in the rod to a longitudinal curve approximating the longitudinal curve of the track.

15. A curved vertical blind closure with slat traversing and rotation comprising, a generally horizontal carriage guide track, the track being longitudinally curved in a generally horizontal plane, a normally straight resiliently bendable blind operating rod, means rotatably supporting the rod on the track with the rod resiliently bowed into a longitudinal curve approximating the longitudinal curve of the track, means for rotating the rod, a plurality of carriages, means for moving the carriages along the track between a blind open and a blind closed position, said means for rotatably supporting the rod on the track including first and second thrust means engaging the rod adjacent opposite ends for applying end thrust thereto, at least one of said thrust means being adjustable in a direction longitudinally of the associated end of the rod to adjust the bow in the rod to a longitudinal curve approximating the longitudinal curve of the track, said one of said thrust means including an end member mounted on one end of the channel, an elongated thrust member slidably and non-rotatably mounted on said end member rotatably engaging an adjacent end of the rod and being for movement relative thereto along an axis coaxial with the adjacent end of the drive rod, the thrust member having an externally threaded portion, and a rotary adjusting member threaded on said externally threaded portion and engaging said end member to adjust the thrust member relative to the end member.

16. A curved vertical blind closure with slat traversing and rotation comprising, a generally horizontal carriage guide track, the track being longitudinally curved in a generally horizontal plane, a normally straight resiliently bendable operating rod, means rotatably supporting the rod on the track with the rod resiliently bowed into a longitudinal curve approximating the longitudinal curve of the track, means for rotating the rod, a plurality of carriages, means for moving the carriages along the track between a blind open and a blind closed position, said means rotatably supporting the blind operating rod on the track including a first end member fixedly mounted on one end of the track and having a first thrust means thereon engaging one end of the rod for applying end thrust thereto, said means for rotating the rod including a speed reducing drive mechanism having a housing means fixed to a second end of the track, an annular internal ring gear in the housing means coaxial with the rod, a planet carrier supported for rotation about the axis of the ring gear and having an axial hub non-rotatably connected to a second end of the rod, a drive wheel having a sun gear at one side extending into the ring gear concentrically of the latter and a drive sprocket at the other side coaxial with the ring gear, at least one planet gear in meshing engagement with the sun and ring gears and mounted on the planet carrier for rotation relative thereto about an axis parallel to the axis of the ring gear, and a second thrust means including a thrust bearing mounted on the housing means and a thrust pin extending from the thrust bearing axially through the drive wheel and sun gear and planet carrier and into engagement with said second end of said rod to apply end thrust thereto, said first thrust means being adjustable relative to the first end member in a direction longitudinally of said one end of the rod to adjust the bow in the rod to a longitudinal curve approximating the longitudinal curve of the track.

17. A curved vertical blind with slat traversing and rotation comprising, a generally horizontal carriage guide track, the track being longitudinally curved in a generally horizontal plane, a normally straight resiliently bendable blind operating rod, means rotatably supporting the rod on the track with the rod resiliently bowed into a longitudinal curve approximating the longitudinal curve of the track, means for rotating the rod, a plurality of carriages, means for moving the carriages along the track between a blind open and a blind closed position, said means rotatably supporting the rod on the track including a first thrust means mounted on a first end of the track and engaging a first end of the rod for applying end thrust thereto, said means for rotating the rod including a speed reducing drive mechanism having a housing means fixed to a second end of the track, an annular internal ring gear in the housing means coaxial with the rod, a planet carrier supported for rotation about the axis of the ring gear and having an axial hub non-rotatably connected to a second end of rod, a drive wheel having a sun gear at one side extending into the ring gear concentrically of the latter and a drive sprocket at the other side coaxial with the ring gear, at least one planet gear in meshing engagement with the sun and ring gears and mounted on the planet carrier for rotation relative thereto about an axis parallel to the axis of the ring gear, and a second thrust means mounted on the housing means and including a thrust member extending axially through the drive wheel and sun gear and planet carrier and into engagement with said second end of said rod to apply end thrust thereto, said first thrust means including an end member mounted on the first end of the track, an elongated thrust member rotatably engaging the first end of the rod and being slidably and non-rotatably mounted on said end members for movement relative thereto along an axis coaxial with the adjacent first end of the rod, the thrust member having an externally threaded portion, and an adjusting member threaded on said external threaded portion and engaging said end member to adjust the thrust member relative to the end member.

* * * * *

UNITED STATES PATENT AND TRADEMARK OFFICE

CERTIFICATE OF CORRECTION

PATENT NO. : 4,830,081

DATED : May 16, 1989

INVENTOR(S) : John E. Morris

It is certified that error appears in the above-identified patent and that said Letters Patent is hereby corrected as shown below:

Claim 6, column 10, line 5, change "tracks" to -- track --.

Claim 14, column 11, line 51, change "tracks" to -- track --.

Claim 15, column 12, line 12, after "member" add -- rotatably engaging an adjacent end of the rod and being --;
line 13, after "member" delete "rotatably";
line 14, delete "engaging an adjacent end of the rod and being".

Claim 17, column 14, line 10, change "members" to -- member--.

Signed and Sealed this

Fifth Day of December, 1989

*Attest:*

JEFFREY M. SAMUELS

*Attesting Officer*

*Acting Commissioner of Patents and Trademarks*